US011688311B2

(12) United States Patent
Yohanan et al.

(10) Patent No.: US 11,688,311 B2
(45) Date of Patent: Jun. 27, 2023

(54) Y-FRAME DIGITAL SIGNAGE SYSTEM

(71) Applicant: TIMESSQUAREDNYC CORP, Brooklyn, NY (US)

(72) Inventors: Leor Yohanan, Brooklyn, NY (US); Mishael M. Mishel, Brooklyn, NY (US)

(73) Assignee: TIMESSQUAREDNYC CORP, Brooklyn, NY (US)

( * ) Notice: Subject to any disclaimer, the term of this patent is extended or adjusted under 35 U.S.C. 154(b) by 39 days.

(21) Appl. No.: 17/168,380

(22) Filed: Feb. 5, 2021

(65) Prior Publication Data

US 2022/0254283 A1 Aug. 11, 2022

(51) Int. Cl.
*G09F 15/00* (2006.01)
*G09F 27/00* (2006.01)

(52) U.S. Cl.
CPC ..... *G09F 15/0012* (2013.01); *G09F 15/0037* (2013.01); *G09F 27/007* (2013.01)

(58) Field of Classification Search
CPC .. G09F 27/00; G09F 15/0006; G09F 15/0007; G09F 15/0037; G09F 15/0012; G09F 13/0448; G09F 13/04; G09F 13/0413; G09F 13/0431; G09F 2023/0008; G07F 17/24; G08G 1/168; G08G 1/14; G08G 1/147
USPC ..... 40/572, 606.01, 606.18, 607.01; 248/127, 152, 158, 146
See application file for complete search history.

(56) References Cited

U.S. PATENT DOCUMENTS

| | | | | |
|---|---|---|---|---|
| 351,990 | A | 11/1886 | Mansure | |
| 930,509 | A | 8/1909 | Warfield | |
| 2,171,345 | A * | 8/1939 | Rockola | G07F 17/24 194/255 |
| 3,068,599 | A * | 12/1962 | Myerson | G09F 13/04 40/667 |
| 5,095,642 | A | 3/1992 | George et al. | |
| 6,139,164 | A | 10/2000 | Bolta et al. | |
| 6,151,821 | A * | 11/2000 | Nakajima | G09F 13/14 40/560 |
| 6,250,003 | B1 * | 6/2001 | Phinney | G09F 15/0037 40/655 |
| D589,563 | S * | 3/2009 | Fitz | D20/21 |
| D598,798 | S * | 8/2009 | Tsui | D10/113.4 |
| 8,472,174 | B2 * | 6/2013 | Idems | H05K 7/20972 361/679.21 |
| 9,286,815 | B1 * | 3/2016 | Smith | E01F 9/692 |
| 2004/0103570 | A1 * | 6/2004 | Ruttenberg | G09F 23/06 40/584 |
| 2005/0091894 | A1 | 5/2005 | Hamilton et al. | |

(Continued)

*Primary Examiner* — Gary C Hoge
(74) *Attorney, Agent, or Firm* — Erise IP, P.A.

(57) ABSTRACT

A signage system and method for providing information wirelessly to the signage system for display on digital monitors. The signage system includes a stand and at least one display mounted on the stand. The stand includes a base, an extension, and an A-frame mount connected to the top of the extension, the A-frame mount having a first face and a second face each extending upwards at an angle from the A-frame base. The first face and the second face are configured to receive digital monitors thereon. The signage system further includes additional faces on both the top and bottom portions for receiving multiple additional advertising displays.

19 Claims, 7 Drawing Sheets

(56) References Cited

U.S. PATENT DOCUMENTS

| | | | | |
|---|---|---|---|---|
| 2007/0063873 | A1* | 3/2007 | Murray | G09F 15/0037 340/932 |
| 2007/0138368 | A1 | 6/2007 | Glass | |
| 2018/0357681 | A1* | 12/2018 | Sullivan | G06F 1/1647 |
| 2019/0289756 | A1* | 9/2019 | Lee | G09F 27/005 |
| 2019/0392738 | A1 | 12/2019 | Topcuoglu | |

* cited by examiner

Y-FRAME DIGITAL SIGNAGE SYSTEM

BACKGROUND

1. Field

Embodiments of the invention relate to a signage system, in particular street signs for advertisements. More specifically, embodiments of the invention relate to a digital signage system.

2. Related Art

Street signs are often used by shopkeepers to display messages in front of their businesses or in aisles within stores. Although many signage stands are known, most do not allow for multiple advertisements to be presented at once. What is needed is a better process for displaying multiple advertisements in a versatile way. A known standard sign has one or two sides where information can be provided. Known signs may receive a paper/board insert therein or may include a chalkboard or whiteboard where a user may write a temporary message. What is presented herein is a versatile signage system for having a unique mount presenting multiple faces for displaying information. Additionally, the present invention can include digital monitors for allowing content to be changed frequently and remotely. Additionally, the present invention can be utilized as a charging station for devices and/or electric vehicles.

The invention describes an improved signage system for advertising and a method for using the same. The unique construction of the signage mount allows for multiple displays to be presented on the same stand.

SUMMARY

Embodiments of the invention solve the above-mentioned problems by providing a signage system and method for providing diverse advertising content.

A first embodiment of the invention is directed to a signage system comprising a stand and at least one display mounted on the stand. The stand comprises a base adapted to be placed on the ground; an extension having a bottom end and a top end, said bottom end connected to the base; an A-frame mount having an A-frame base, a first face, and a second face, wherein the first face extends at a first angle from a top surface of the A-frame base and the second face extends at a second angle from the top surface of the A-frame base, wherein the A-frame mount is connected to the top end of the extension. The at least one display comprises at least a first digital monitor mounted on the first face. The at least one display may comprise a second digital monitor mounted on the second face.

Additional embodiments of the invention are directed to method of presenting advertising to customers comprising providing a signage system, including a signage stand and at least one digital display, and receiving information wirelessly to be displayed on a first digital monitor and/or a second digital monitor.

Another embodiment is directed to a signage stand comprising a base adapted to be placed on the ground; an extension having a bottom end and a top end, said bottom end connected to the base; and an A-frame mount connected to the top end of the extension. The A-frame mount comprises an A-frame base, a first face, and a second face, said first face formed by a first frame leg, a second frame leg, a top frame leg, and an intermediate arm, said first face extending at a first angle from a top surface of the A-frame base, said second face formed by a first frame leg, a second frame leg, a top frame leg, and an intermediate arm, and said second face extending at a second angle from the top surface of the A-frame base, wherein the first angle is equal to the second angle, and wherein the first face and the second face are each configured to receive a display thereon.

Embodiments of the invention are directed to a signage system and method for providing information wirelessly to the signage system for display on digital monitors. The signage system includes a stand and at least one display mounted on the stand. The stand includes a base, an extension, and an A-frame mount connected to the top of the extension, the A-frame mount having a first face and a second face each extending upwards at an angle from the A-frame base. The first face and the second face are configured to receive digital monitors thereon. The signage system further includes additional faces on both the top and bottom portions for receiving multiple additional advertising boards.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
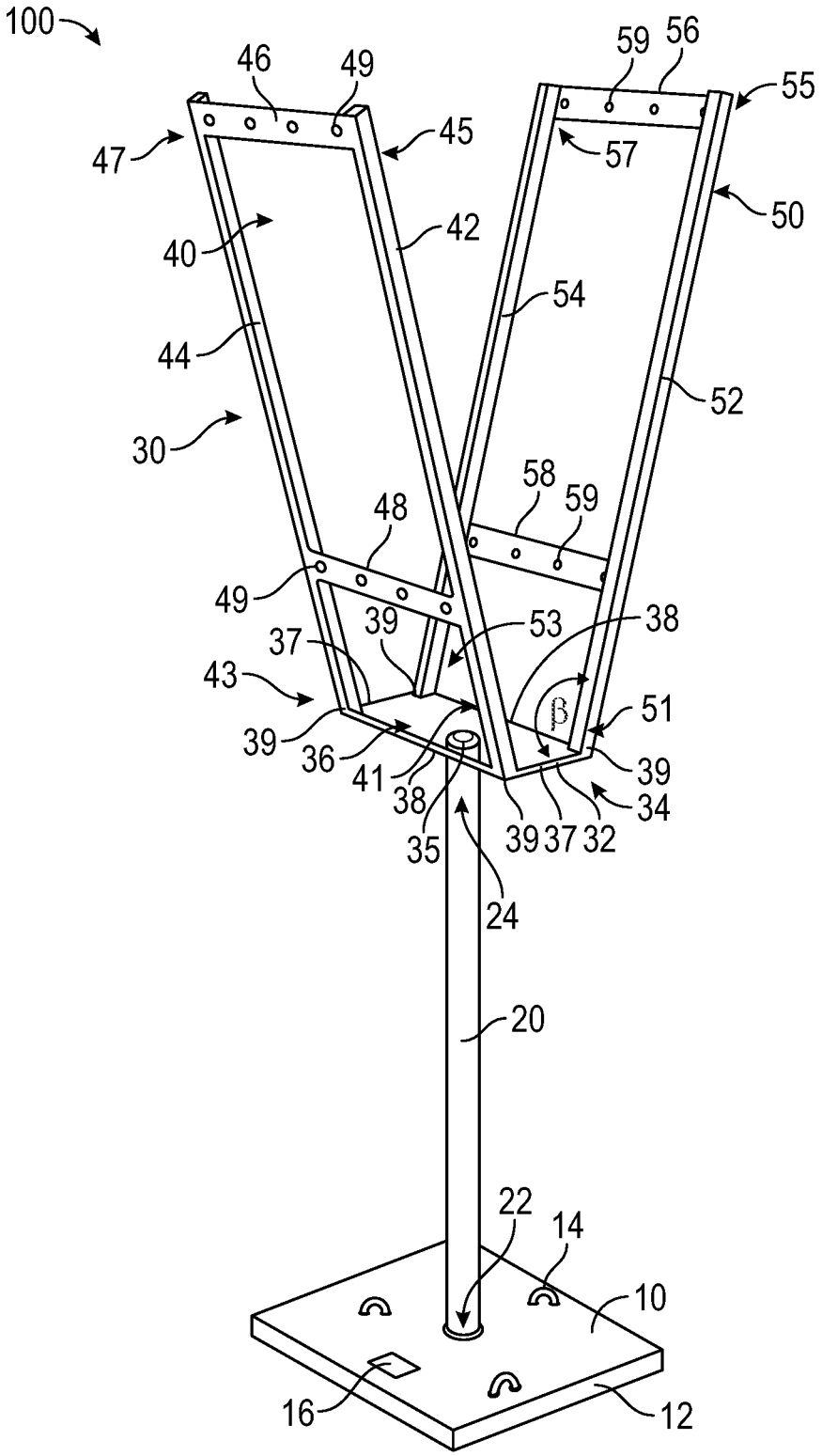
FIG. 1 is a perspective view of a first embodiment of a signage stand including the A-frame mount.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

FIG. 1 illustrates a first embodiment of a signage stand 100. Stand 100 includes a base 10 and an extension 20 extending vertically therefrom. Extension 20 has a bottom end 22 attached to base 10 and a top end 24 for receiving an A-frame mount 30 thereon. A-frame mount 30 is configured to receive at least one display thereon. Such a configuration may be considered to be a Y-frame signage stand. In some embodiments, the display may be reusable display or a disposable display. In some embodiments, the display may be a chalkboard, a whiteboard, a posterboard, paper signage, or a digital or electronic monitor.

In some embodiments, extension 20 may be a hollow cylindrical pole having a circular cross-section. In other embodiments, extension 20 may be a hollow rectangular pillar having a square cross-section. In other embodiments, extension 20 may be a hollow planar rectangular support having a rectangular cross-section. In other embodiments, extension 20 may be solid for providing additional support. In some embodiments, two or more spaced apart extensions 20 may be provided to provide additional support for the A-frame base 32 of the A-frame mount 30. In embodiments where extension 20 is hollow, one or more electrical wires may be provided within the lumen for connecting monitors 200 to a battery 16 or other power source that may be housed within the base 10. In some embodiments, one or more communication cables may be provided in the lumen for providing data to the monitors 200.

In some embodiments, the base 10 is a substantially planar square platform, as seen in FIG. 1. In some embodiments, the base 10 may have a length and/or width of about 10-20 inches. In some embodiments, the base 10 may have a diameter of about 10-20 inches, or more specifically 16-18 inches. In other embodiments, base 10 may have other shapes, such as a rectangle, circle, or triangle. In some embodiments, base 10 may include a weight 12 therein for ensuring the stand 100 does not fall over. Weight 12 may be of any suitable known construction, such as metal, and of a magnitude to provide proper balance to the stand 100. Base 10 may include an attachment means 14 for receiving anchors thereon. Attachment means 14 may be holes, openings, hooks, loops, or any other suitable means for receiving an anchor thereon. In some embodiments, anchors may include ropes, metals fasteners, or plastic ties, or other known suitable means for attaching the base 10 to a desired location and helping to balance the stand 100. In some embodiments, base 10 may include lockable wheels (not shown) on a lower surface for allowing easier movement of the stand 100.

In some embodiments, the base 10 may include at least one rechargeable and/or replaceable battery 16 housed therein, as will be explained further below, for charging the monitors 200 or other devices. In some embodiments, base 10 may include an electrical cord and plug (not shown) for recharging a battery 16 and/or for providing power directly to the monitors 200. Electrical cord and plug may be stored in a waterproof sealed compartment in the base 10 when not in use. In some embodiments, the stand may include solar panels for recharging the battery 16 or other power source. Solar panels (not shown) may be located anywhere on the stand 100, preferably in locations which will receive the most amount of sunlight. In some embodiments, solar panels are provided on at least a top surface of the stand 100.

In some embodiments, the stand 100 may also act as a charging station. The stand may include at least one power outlet (not shown) for receiving a power plug or a USB cable for charging a user's device, such as a cell phone. In some embodiments, the stand may also include a power receptacle (not shown) for charging a user's electric vehicle. In some embodiments, the power source may be designed to provide at least a boost charge to an electric vehicle to enable a user to reach another electric vehicle charging station. In some embodiments, the stand is configured to be connected to a known power adapter for providing a station for electric vehicle charging.

A-frame mount 30 includes an A-frame base 32, a first face 40, and a second face 50. A-frame base 32 may be a rectangular base having a bottom surface 34, a top surface 36, two short sides 37, two long sides 38, and four corners 39. Bottom surface 34 is mounted on the extension 20, such as by welding, gluing, mechanical fasteners, or other attachment means. First face 40 and second face 50 extend at an angle R from the top surface of A-frame base 32. In some embodiments, angle R may be about 30-60 degrees. In some embodiments, angle R may be about 40 degrees. First face 40 and second face 50 are each attached to a long side 38 of A-frame base 32. In some embodiments, the first face 40 and the second face 50 are spaced apart by about 25-35 inches. In some embodiments, the first face 40 and the second face 50 are spaced apart by about 27 inches.

In some embodiments, first face 40 is substantially rectangular and includes a first frame leg 42, a second frame leg 44, a top frame leg 46, and an intermediate arm 48. A first end 41 of first frame leg 42 is attached to base 32 near a first corner 39 and a first end 43 of second frame leg 44 is attached to base 32 near a second corner 39. A second end 45 of first frame leg 42 and a second end 47 of second frame leg 44 are attached to top frame leg 46. Intermediate arm 48 extends across the rectangular opening formed between first frame leg 42 and second frame leg 44. In some embodiments, intermediate arm 48 includes holes or openings 49 for receiving an attachment means therein for attaching a display to the first face 40. In some embodiments, intermediate arm 48 includes an attachment means for attaching a display, such as monitor 200, to the first face 40. In some embodiments, top frame leg 46 includes holes or openings 49 for receiving an attachment means therein or includes an attachment means. In some embodiments, the attachment means may be bolts, screws, or other removable mechanical fasteners.

Second face 50 may be substantially similar to first face 40. In some embodiments, second face 50 is substantially rectangular and includes a first frame leg 52, a second frame leg 54, a top frame leg 56, and an intermediate arm 58. A first end 51 of first frame leg 52 is attached to base 32 near a third corner 39 and a first end 53 of second frame leg 54 is attached to base 32 near a fourth corner 39. A second end 55 of first frame leg 52 and a second end 57 of second frame leg 54 are attached to top frame leg 56. Intermediate arm 58 extends across the rectangular opening formed between first frame leg 52 and second frame leg 54. In some embodiments, intermediate arm 58 includes holes or openings 59 for receiving an attachment means therein for attaching a display, such as monitor 200, to the second face 50. In some embodiments, intermediate arm 58 includes an attachment means for attaching a display to the second face 50. In some embodiments, top frame leg 56 includes holes or openings 59 for receiving an attachment means therein or includes an attachment means. In some embodiments, the attachment means may be bolts, screws, or other removable mechanical fasteners.

In some embodiments, first face 40 may receive a digital monitor 200 thereon. In some embodiments, second face 50 may include a different type or size of display. In some embodiments, second face 50 may receive a second digital monitor 200 thereon. In some embodiments, a first monitor 200 may be attached to the intermediate arm 48 and/or the top frame leg 46 of the first face 40. Additionally, a second monitor 200 may be attached to the intermediate arm 58 and/or the top frame leg 56 of the second face 50. In some embodiments, the display may be the same size or larger than the first face 40 or the second face 50. In some embodiments, monitor 200 may have a width of about 10-20 inches. In some embodiments, monitor 200 may have a width of about 12-14 inches. In some embodiments, the monitor 200 may have a height of about 35-45 inches. In some embodiments, the monitor 200 may have a width of about 13 inches and a height of about 38 inches. In some embodiments, the monitor 200 may have a thickness/depth of about 2-4 inches. In some embodiments, the monitor 200 may be 37.0 inch (diagonal) color monitor with a 1920×540 pixel resolution display. In some embodiments, the total height of the stand 100 with a display attached is between about 5-6 feet. In some embodiments, the total height of the stand 100 with a display attached is about 66 inches.

Figure 2:
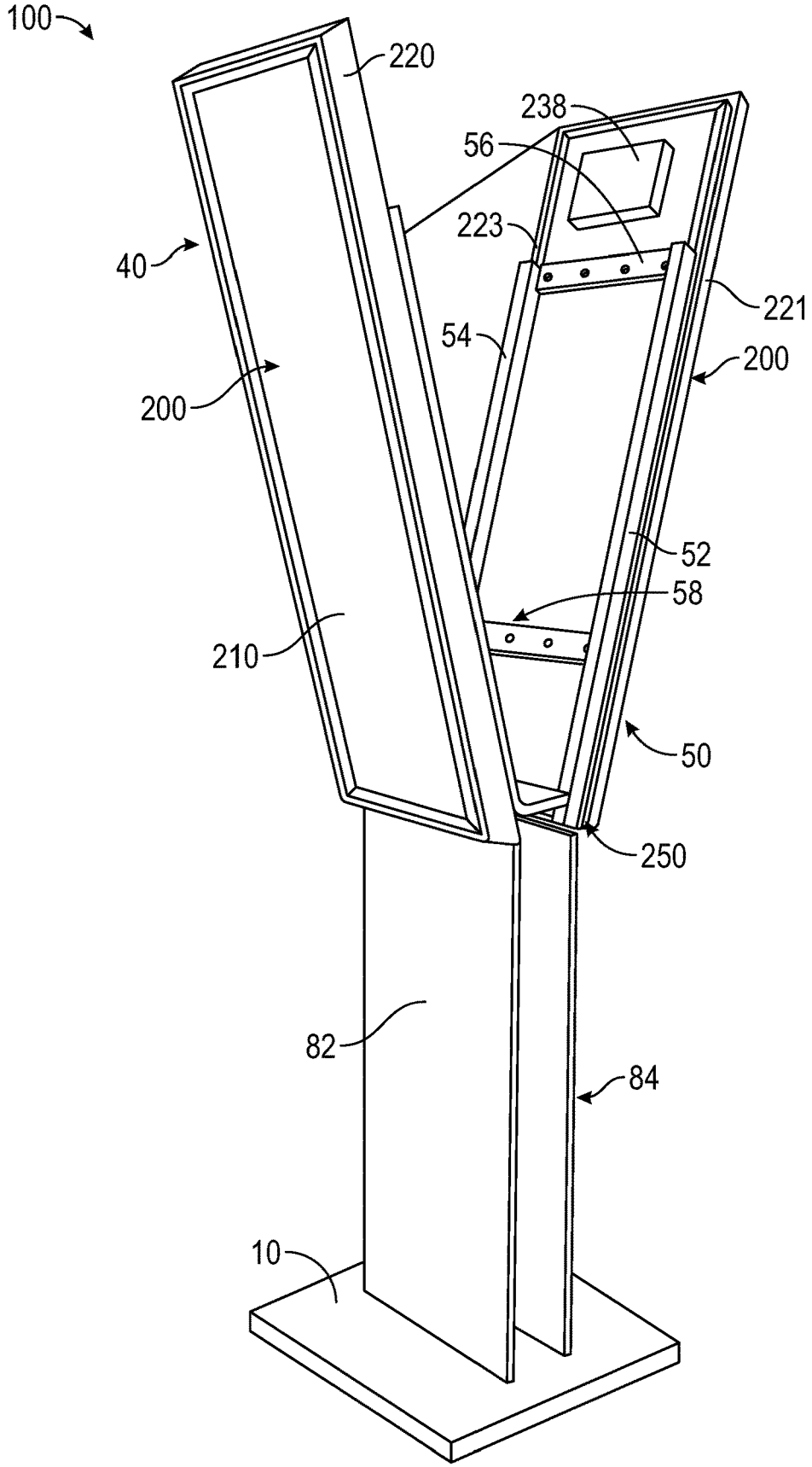
FIG. 2 is a perspective view of the first embodiment of a signage stand including two monitors mounted on the A-frame mount.
Figure 3:
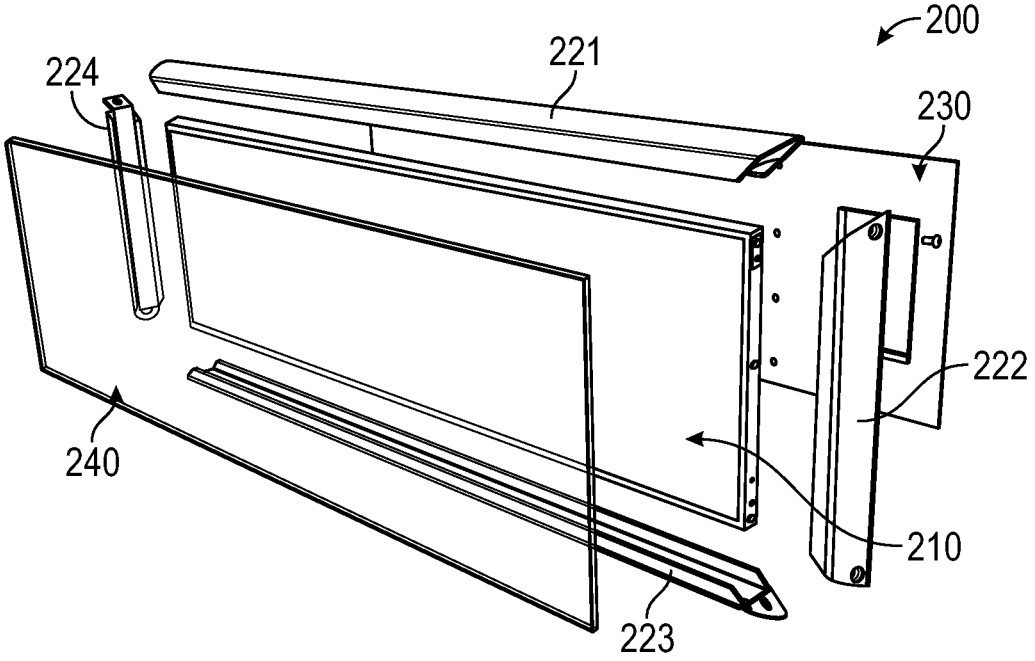
FIG. 3 is an exploded view of an exemplary monitor.

As seen in FIGS. 3 and 4, monitor 200 may include a display screen 210, a peripheral frame 220, a back cover 230, and a front protector 240. Frame 220 may include side pieces 221, 222, 223, 224 that may be attached to the sides of the display screen 210, such as by mechanical attachment means. In some embodiments, side piece 221 may cooperate with first frame leg 42, 52 and side piece 223 may cooperate with second frame leg 44, 54, as seen in FIG. 2. In some embodiments, the side pieces 221, 223 are adjacent to an outer side of the first frame leg 42, 52 and second frame leg 44, 54. In some embodiments, a narrow channel 250 is provided between the side piece 221 and the first frame leg 42, 52 and between side piece 223 and second frame leg 44, 54. In some embodiments, a front protector 240 may be provided on the front surface of the display screen 210.

Figures 4A, 4B:
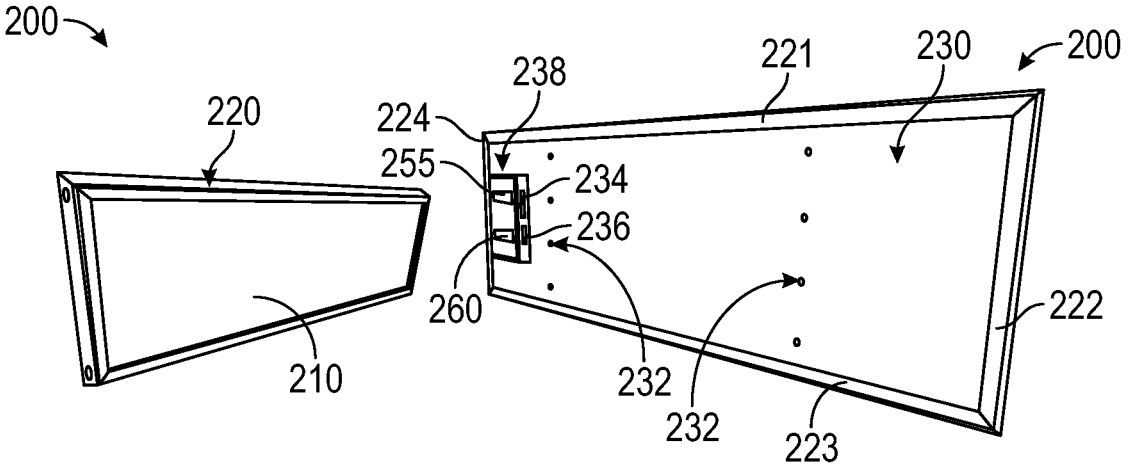
FIG. 4A is a front view of an exemplary monitor and FIG. 4B is a back view of an exemplary monitor.

As seen in FIG. 4B, back cover 230 may include holes or openings 232 for mounting the monitor 200 to the A-frame mount 30. The openings 232 on the back cover 230 may be aligned with the openings 49, 59 in the intermediate arms 48, 58 and/or top frame legs 46, 56 for mounting the monitor 200. Ports 234, 236 may be provided on the back cover 230 for attaching power cables and/or communication cables to the monitor 200. In some embodiments, the ports 234, 236 may be provided in a protrusion 238 on the back cover 230 that is located above the top frame leg 46, 56 when attached to the A-frame mount 30. In some embodiments, the protrusion 238 may be provided on the back cover 230 at a location that is near the A-frame base 32 such that any cables attached thereto would have a shorter distance to traverse. Cables may be received through an opening 35 in A-frame base 32 and extend through a hollow lumen of extension 20, as discussed above.

Figure 6A:
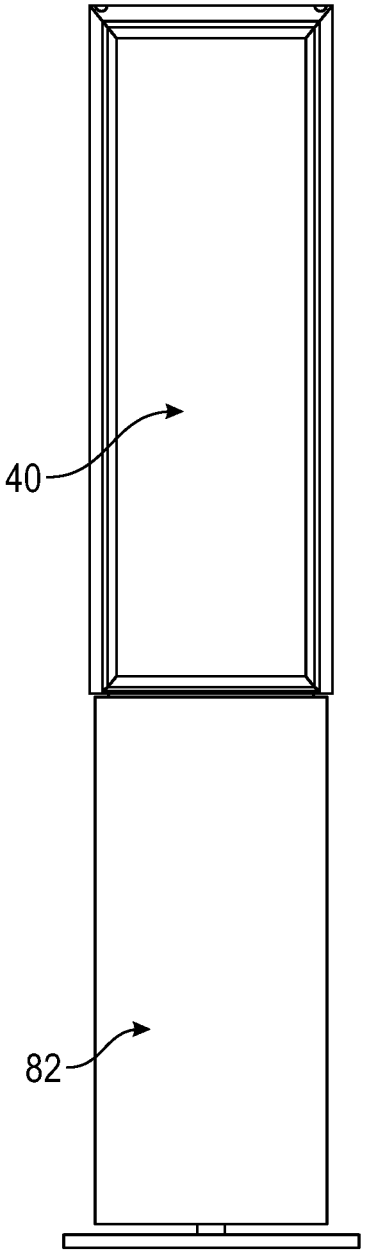
FIG. 6A is a front view of the signage stand showing a monitor and an additional bottom advertising board.
Figure 6B:
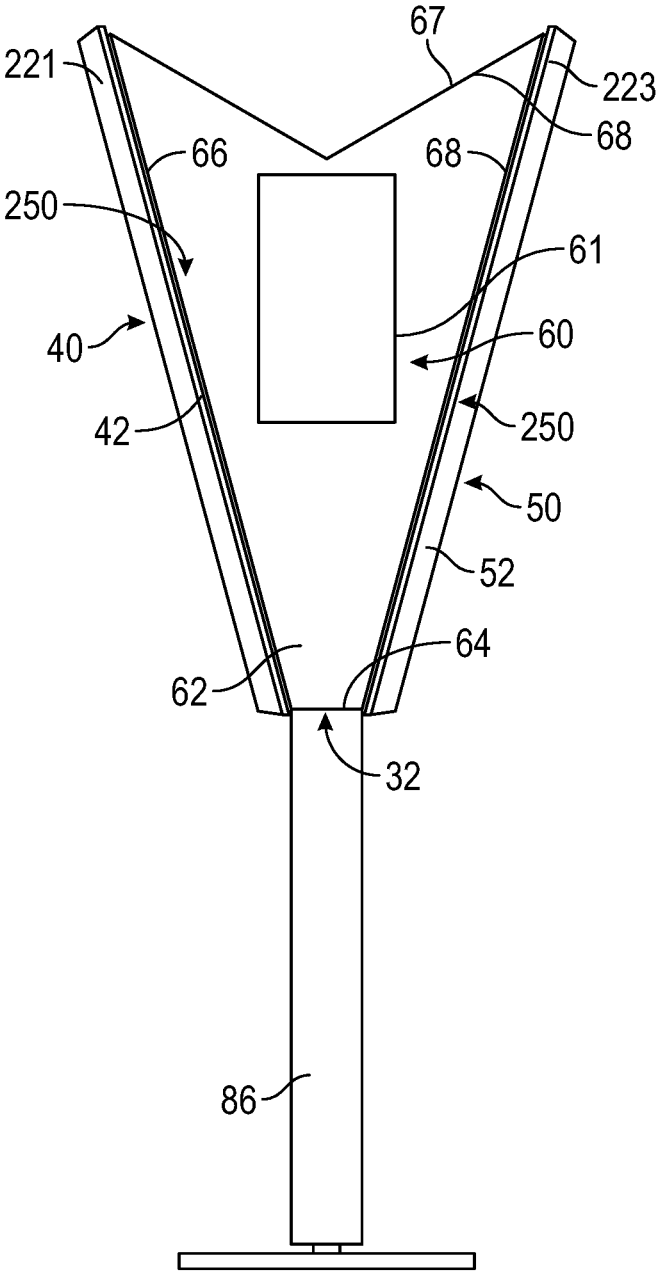
FIG. 6B is a side view of the signage stand showing two monitors and an additional top advertising board.
Figure 8A:
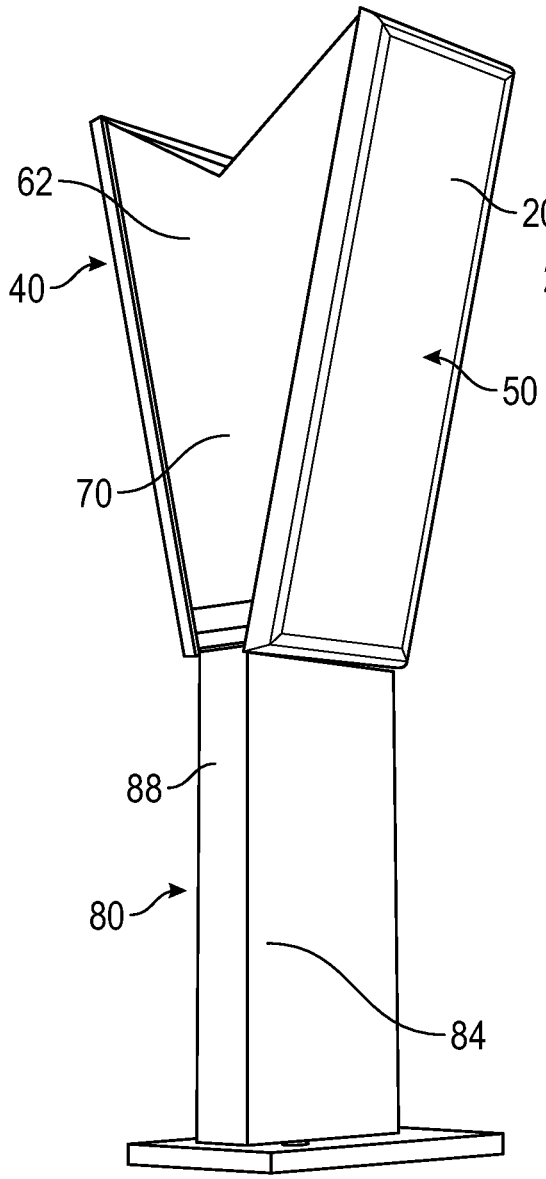
FIGS. 8A and 8B are perspective views of the signage stand including two monitors and multiple advertising boards.
Figure 8B:
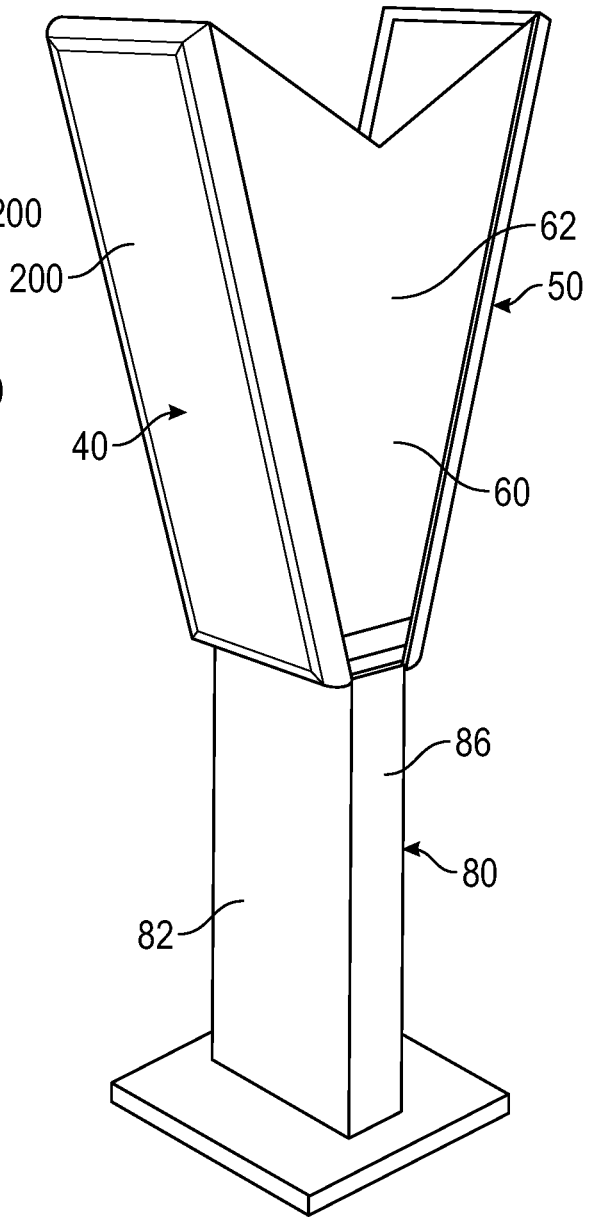

In addition to the first face 40 and second face 50 for receiving displays, the stand 100 is designed such that additional advertising may be provided thereon. In some embodiments, an advertising board 62 may be provided on a third face 60 of the A-frame mount 30 between first frame leg 42 and first frame leg 52 as seen in FIGS. 6B and 8B. In some embodiments, an additional advertising board 62 may be provided on a fourth face 70 of the A-frame mount 30 between second frame leg 44 and second frame leg 54, as seen in FIG. 8A. In some embodiments, the third face 60 and/or the fourth face 70 may include a supplementary monitor 61 of a smaller size, as seen in FIG. 6B. In some embodiments, the size of the supplementary monitor 61 may be about 20-22 inches (diagonal). Supplementary monitor 61 may be configured similar to monitor 200. In some embodiments, supplementary monitor 61 may be mounted within an opening in advertising board 62. In some embodiments, A-frame mount 30 may include additional bracing (not shown) for supporting and attaching supplementary monitor 61, which may extend between the first frame leg 42 and the first frame leg 52 and/or between the second frame leg 44 and the second frame leg 54. Thus, in some embodiments, a total of four digital monitors may be provided on the A-frame mount 30.

Advertising board 62 may be a planar board of a thickness of about 0.25 inch to about 0.5 inch. In some embodiments, advertising board 62 may be substantially V-shaped with a flat bottom 64, a first side 66, a second side 68, and a top edge 67, s seen in FIG. 6B. In some embodiments, first side 66 may be received within a first channel 250 between side piece 221 and first frame leg 42 and second side 68 may be received within second channel 250 between side piece 223 and first frame leg 52. In some embodiments, flat bottom 64 may rest on top surface 36 of frame base 32. In some embodiments, top edge 67 may be V-shaped, as shown in FIG. 8B, for aesthetics and to allow for better wind resistance.

Figure 5:
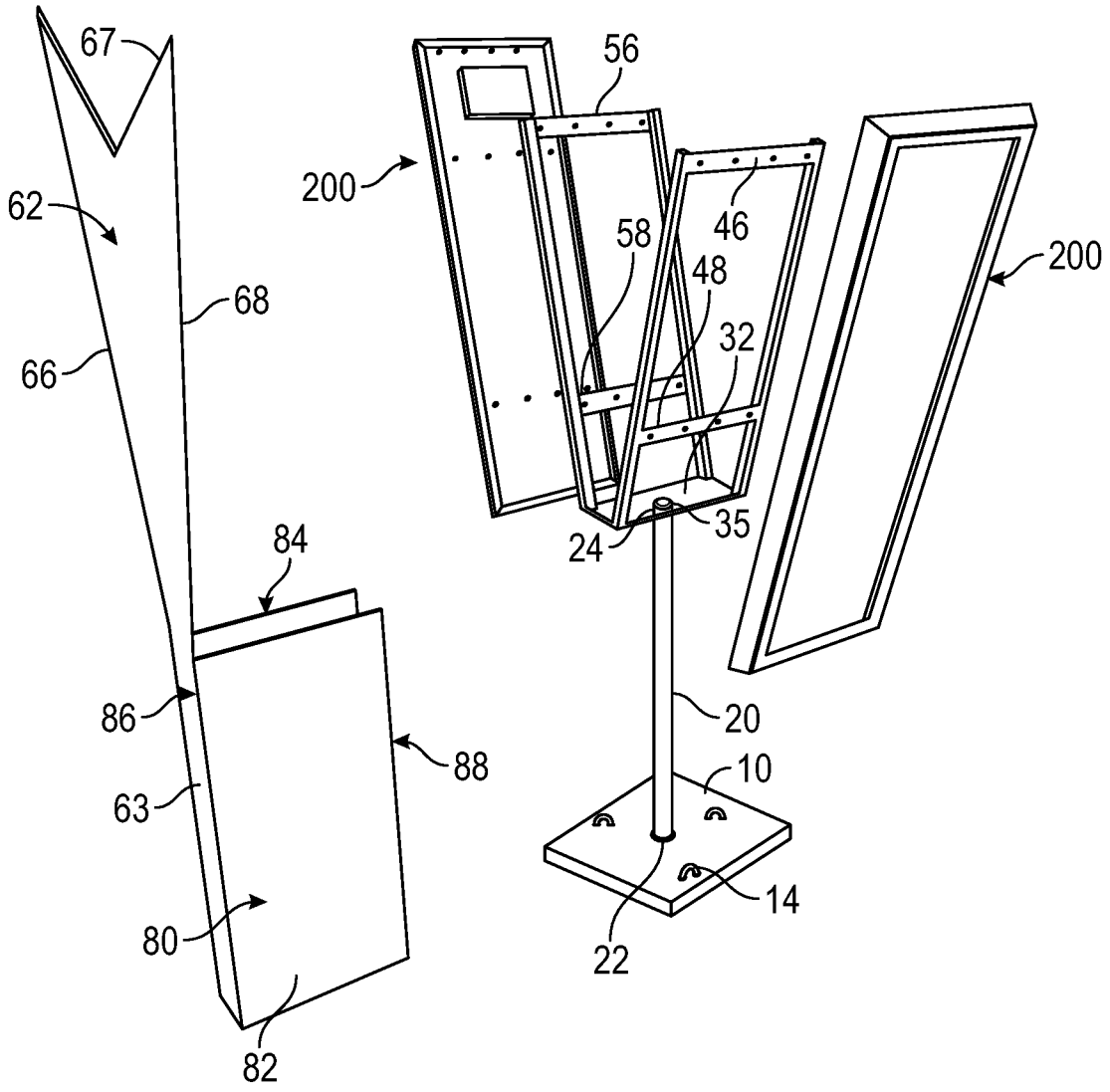
FIG. 5 is an exploded view of the first embodiment of a signage stand including two monitors and additional advertising boards.

In some embodiments, advertising board 62 may be substantially Y-shaped having a first side 66 and a second side 68 and a top edge 67, and a bottom rectangular stem 63, as seen in FIG. 5. The bottom rectangular stem 63 of advertising board 62 may extend along the height of extension 20 and towards base 10.

In some embodiments, an additional advertising assembly 80 is provided on a bottom portion of stand 100 surrounding the extension 20. Advertising assembly 80 includes a fifth face 82, a sixth face 84, a seventh face 86, and an optional eighth face 88.

With reference to FIGS. 5, 8A and 8B, advertising assembly 80 may be configured as a rectangular sandwich board with fifth face 82 and sixth face 84 being spaced apart from each other and enclosing extension 20 therebetween. Fifth face 82 and sixth face 84 may extend substantially vertically from the base 10. In some embodiments, fifth face 82 is provided on the same side as first face 40 and sixth face 84 is provided on the same side as second face 50. In some embodiments, seventh face 86 is provided on the same side as third face 60 and eighth face 88 is provided on the same side as fourth face 70. Advertising assembly 80 may be connected to extension 20 or mounted around extension 20.

In some embodiments, advertising assembly 80 is unitary with at least one advertising board 62 that is mounted on the upper portion of stand 100. In some embodiments, stem 63 of advertising board 62 forms the seventh face 86 or the eighth face 88 of assembly 80. In some embodiments, advertising assembly 80 may be configured to connect to itself by releasable fasteners, such as hook and loop fasteners, tape, or other mechanical fasteners. In some embodiments, the eighth face 88 may be open, as seen in FIG. 5, such that the assembly 80 can be easily received around extension 20.

In some embodiments, all or part of base 10, extension 20, and A-frame mount 30 may be comprised of any suitable material, such as metal or polymers. In some embodiments, some or all components are made of stainless steel or aluminum. In some embodiments, all or part of frame 220 may comprise a metal material, such as aluminum. In some embodiments, back cover 230 may comprise sheet metal. In some embodiments, front protector 240 may be comprised of a transparent material such as acrylic, Plexiglas®, Lexan®, polycarbonate resin thermoplastic, or another polymer.

In some embodiments, the monitor 200 may comprise a processor 255 and/or a memory 260 for receiving and storing data. Monitor 200 is configured to be attached to a power source, such as a battery 16 or an electrical cord to be plugged into a standard outlet, via port 234. Monitor 200 is also configured to be attached to a computing device 702, via port 236. Monitor 200 may also be configured to receive data from a computing device 702 or other peripheral device wirelessly or through a wired data connection, such that the advertising content or information displayed can be updated easily and frequently.

Figure 7:
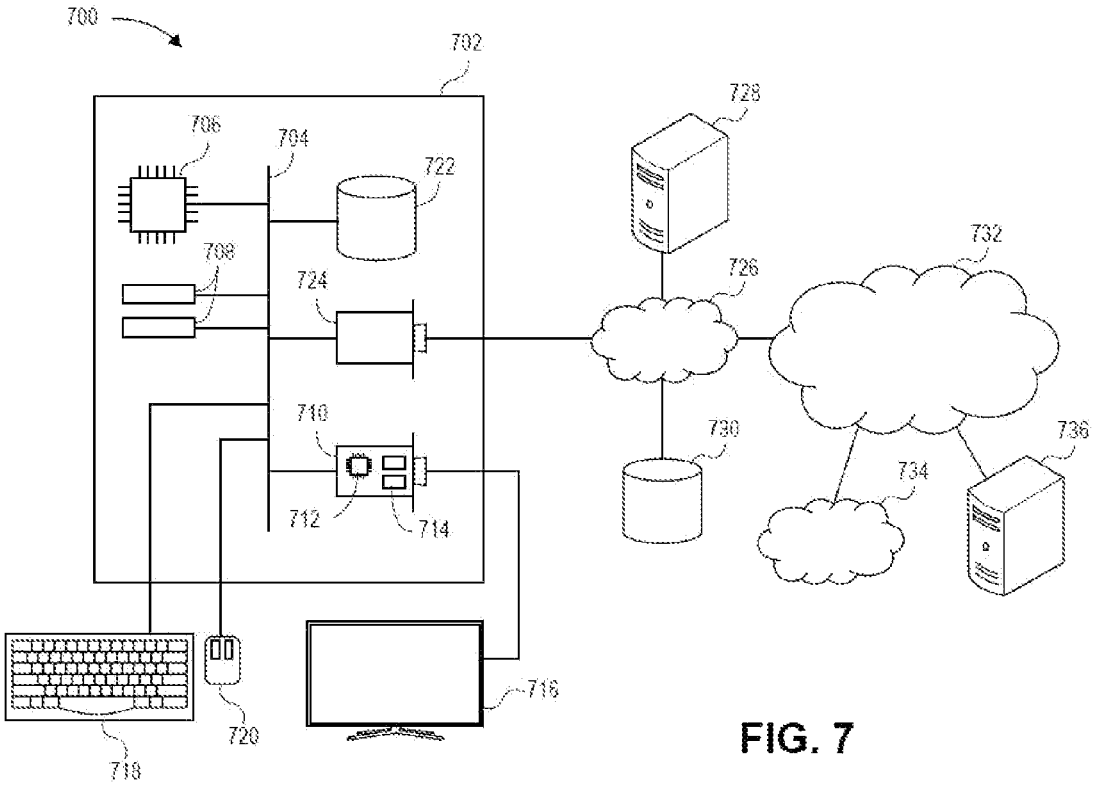
FIG. 7 shows an exemplary computer hardware system.

FIG. 7 illustrates an exemplary computer hardware system 700. Computing device 702 can be a desktop computer, a laptop computer, a server computer, a mobile device such as a smartphone or tablet, or any other form factor of general- or special-purpose computing device. Depicted with computing device 702 are several components, for illustrative purposes. In some embodiments, certain components may be arranged differently or absent. Additional components may also be present. Included in computing device 702 is system bus 704, whereby other components of computing device 702 can communicate with each other. In certain embodiments, there may be multiple busses or components may communicate with each other directly. Connected to system bus 704 is central processing unit (CPU) 706. Also attached to system bus 704 are one or more random-access memory (RAM) modules 708.

Also attached to system bus 704 is graphics card 710. In some embodiments, graphics card 710 may not be a physically separate card, but rather may be integrated into the motherboard or the CPU 706. In some embodiments, graphics card 710 has a separate graphics-processing unit (GPU) 712, which can be used for graphics processing or for general purpose computing (GPGPU). Also on graphics card 710 is GPU memory 714. Connected (directly or indirectly) to graphics card 710 is computer display 716 for user interaction. In some embodiments no display is present, while in others it is integrated into computing device 702. Similarly, peripherals such as keyboard 718 and mouse 720 are connected to system bus 704. Like computer display 716, these peripherals may be integrated into computing device 702 or absent. Also connected to system bus 704 is local storage 722, which may be any form of computer-readable media, and may be internally installed in computing device 702 or externally and removably attached.

Finally, network interface card (NIC) 724 is also attached to system bus 704 and allows computing device 702 to communicate over a network such as network 726. NIC 724 can be any form of network interface known in the art, such as Ethernet, ATM, fiber, Bluetooth, or Wi-Fi (i.e., the IEEE 802.11 family of standards). NIC 724 connects computing device 702 to local network 726, which may also include one or more other computers, such as computer 728, and network storage, such as data store 730. Local network 726 is in turn connected to Internet 732, which connects many networks such as local network 726, remote network 734 or directly attached computers such as computer 736. In some embodiments, computing device 702 can itself be directly connected to Internet 732.

The computer program of embodiments of the invention comprises a plurality of code segments executable by a computing device for performing the steps of various methods of the invention. The steps of the method may be performed in the order discussed, or they may be performed in a different order, unless otherwise expressly stated. Furthermore, some steps may be performed concurrently as opposed to sequentially. Also, some steps may be optional. The computer program may also execute additional steps not described herein. The computer program, system, and method of embodiments of the invention may be implemented in hardware, software, firmware, or combinations thereof, which broadly comprises server devices, computing devices, and a communications network.

The computer program of embodiments of the invention may be responsive to user input. As defined herein user input may be received from a variety of computing devices including but not limited to the following: desktops, laptops, calculators, telephones, smartphones, smart watches, in-car computers, camera systems, or tablets. The computing devices may receive user input from a variety of sources including but not limited to the following: keyboards, keypads, mice, trackpads, trackballs, pen-input devices, printers, scanners, facsimile, touchscreens, network transmissions, verbal/vocal commands, gestures, button presses or the like.

The monitor 200, server devices, and computing devices 702 may include any device, component, or equipment with a processing element and associated memory elements. The processing element may implement operating systems, and may be capable of executing the computer program, which is also generally known as instructions, commands, software code, executables, applications ("apps"), and the like. The processing element may include processors, microprocessors, microcontrollers, field programmable gate arrays, and the like, or combinations thereof. The memory elements may be capable of storing or retaining the computer program and may also store data, typically binary data, including text, databases, graphics, audio, video, combinations thereof, and the like. The memory elements may also be known as a "computer-readable storage medium" and may include random access memory (RAM), read only memory (ROM), flash drive memory, floppy disks, hard disk drives, optical storage media such as compact discs (CDs or CDROMs), digital video disc (DVD), and the like, or combinations thereof. In addition to these memory elements, the server devices may further include file stores comprising a plurality of hard disk drives, network attached storage, or a separate storage network.

The computing devices may specifically include mobile communication devices (including wireless devices), workstations, desktop computers, laptop computers, palmtop computers, tablet computers, portable digital assistants (PDA), smartphones, and the like, or combinations thereof. Various embodiments of the computing device may also include voice communication devices, such as cell phones and/or smartphones. In preferred embodiments, the computing device will have an electronic display operable to display visual graphics, images, text, etc. In certain embodiments, the computer program facilitates interaction and communication through a graphical user interface (GUI) that is displayed via the electronic display. The GUI enables the user to interact with the electronic display by touching or pointing at display areas to provide information to the monitor 200.

The communications network may be wired or wireless and may include servers, routers, switches, wireless receivers and transmitters, and the like, as well as electrically conductive cables or optical cables. The communications network may also include local, metro, or wide area networks, as well as the Internet, or other cloud networks. Furthermore, the communications network may include cellular or mobile phone networks, as well as landline phone networks, public switched telephone networks, fiber optic networks, or the like.

The computer program may run on computing devices or, alternatively, may run on one or more server devices. In certain embodiments of the invention, the computer program may be embodied in a stand-alone computer program (i.e., an "app") downloaded on a user's computing device or in a web-accessible program that is accessible by the user's computing device via the communications network. As used herein, the stand-alone computer program or web-accessible program provides users with access to an electronic resource from which the users can interact with various embodiments of the invention.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A signage system comprising:

a stand comprising:

a base adapted to be placed on a ground surface;

an extension having a bottom end and a top end, said bottom end connected to the base;

a Y-frame mount having a Y-frame base, a first face, a second face, a third face, and a fourth face, wherein the first face extends at a first angle from a top surface of the Y-frame base and the second face extends at a second angle from the top surface of the Y-frame base, wherein the first face comprises a first frame leg, a second frame leg, a top frame leg, and an intermediate arm, wherein the intermediate arm is coupled to each of the first frame leg and the second frame leg and is further disposed between the top frame leg and the top surface of the Y-frame mount, wherein the second face comprises a first frame leg, a second frame leg, a top frame leg, and an intermediate arm, wherein the third face is formed between the first frame leg of the first face and the first frame leg of the second face, wherein the fourth face is formed between the second frame leg of the first face and the second frame leg of the second face, wherein the Y-frame mount is connected to the top end of the extension; and a plurality of displays mounted on the stand, said plurality of displays comprising:

a first display mounted on the first face, wherein said first display is a first digital monitor and is attached to the first face at the top frame leg and at the intermediate arm of the first face;

a second display mounted on the second face, wherein said second display is a second digital monitor and is attached to the second face;

a third display mounted on the third face; and a fourth display mounted on a fourth face.

2. The system of claim 1, wherein said plurality of displays further comprises a first lower display mounted below the Y-frame mount and surrounding the extension, said first lower display comprising an advertising board.

3. The system of claim 2, wherein said plurality of displays further comprises a second lower display mounted below the Y-frame mount and surrounding the extension, said second lower display being spaced apart from the first lower display.

4. The system of claim 1, wherein said plurality of displays further comprises:

an additional unitary display assembly comprising:

a third upper display, a first lower display, and a second lower display, wherein the first lower display and the second lower display are mounted below the Y-frame mount and surrounding the extension.

5. The system of claim 1, wherein the extension is hollow and configured to receive at least one cable therethrough for providing power to the plurality of displays.

6. The system of claim 1, wherein the base further comprises a power source for charging the plurality of displays.

7. The system of claim 1, wherein the base further comprises at least one attachment point for receiving at least one anchor to secure the base to the ground surface.

8. The system of claim 1, wherein said third display is configured to receive a third digital monitor and wherein said fourth display is configured to receive a fourth digital monitor.

9. A method of presenting advertising to customers comprising:

providing a signage system comprising:

a stand comprising:

a base adapted to be placed on a ground surface;

an extension having a bottom end and a top end, said bottom end connected to the base; and a Y-frame mount having a Y-frame base, a first face, a second face, a third face, and a fourth face, wherein the first face extends at a first angle from a top surface of the Y-frame base and the second face extends at a second angle from the top surface of the Y-frame base, wherein the first face comprises a first frame leg, a second frame leg, a top frame leg, and an intermediate arm, wherein the intermediate arm is coupled to each of the first frame leg and the second frame leg and is further disposed between the top frame leg and the top surface of the Y-frame mount, wherein the second face comprises a first frame leg, a second frame leg, a top frame leg, and an intermediate arm, wherein the third face is formed between the first frame leg of the first face and the first frame leg of the second face, wherein the fourth face is formed between the second frame leg of the first face and the second frame leg of the second face, wherein the Y-frame mount is connected to the top end of the extension;

mounting a plurality of displays on the stand, said plurality of displays comprising:

a first display, wherein said first display is a first digital monitor mounted on the first face, wherein said first digital monitor is attached to the first face at the top frame leg and at the intermediate arm of the first face;

a second display mounted on the second face, wherein said second display is a second digital monitor and is attached to the second face;

a third display mounted on the third face; and a fourth display mounted on a fourth face; and receiving information wirelessly to be displayed on the plurality of displays.

10. The method of claim 9, further comprising:

mounting an additional display assembly on a lower portion of the stand surrounding the extension.

11. The method of claim 10, wherein the additional display assembly comprises a first lower display spaced apart from a second lower display, a closed side, and an open side, the method further comprising:

sliding the open side around the extension and anchoring the first lower display to the second lower display across the open side.

12. The method of claim 9, wherein the base further comprises at least one attachment point for receiving at least one anchor to secure the base to the ground surface.

13. The method of claim 9, wherein the extension is hollow and configured to receive at least one cable therethrough for providing power to the plurality of displays, and wherein the base further comprises a power source for charging the plurality of displays.

14. The method of claim 9, wherein said third display is configured to receive a third digital monitor and wherein said fourth display is configured to receive a fourth digital monitor.

15. A signage stand comprising:

a base adapted to be placed on a ground surface;

an extension having a bottom end and a top end, said bottom end connected to the base; and a Y-frame mount connected to the top end of the extension, said Y-frame mount comprising:

a Y-frame base, a first face, a second face, a third face, and a fourth face, said first face formed by a first frame leg, a second frame leg, a top frame leg, and an intermediate arm, wherein the intermediate arm is coupled to each of the first frame leg and the second frame leg and is further disposed between the top frame leg and the top surface of the Y-frame mount, said first face extending at a first angle from a top surface of the Y-frame base, said second face formed by a first frame leg, a second frame leg, a top frame leg, and an intermediate arm, wherein the intermediate arm is coupled to each of the first frame leg and the second frame leg and is further disposed between the top frame leg and the top surface of the Y-frame mount; and said second face extending at a second angle from the top surface of the Y-frame base, wherein the first angle is equal to the second angle, wherein the first face, the second face, the third face, and the fourth face are each configured to receive a display thereon, wherein a first display is attached to the first face at the top frame leg and at the intermediate arm of the first face and a second display is attached to the second face at the top frame leg and at the intermediate arm of the second face;

said third face formed between the first frame leg of the first face and the first frame leg of the second face, and wherein the third face is configured to receive a third display; and said fourth face is formed between the second frame leg of the first face and the second frame leg of the second face, and wherein the fourth face is configured to receive a fourth display.

16. The signage stand of claim 15, wherein the base comprises a power source.

17. The signage stand of claim 15, wherein the extension is hollow and configured to receive at least one cable therethrough for charging the display.

18. The signage stand of claim 15, wherein the base further comprises at least one attachment point for receiving at least one anchor to secure the base to the ground surface.

19. The signage stand of claim 15, wherein the extension is hollow and configured to receive at least one cable therethrough for providing power to the first display and the second display, and wherein the base further comprises a power source for charging the first display and the second display.

* * * * *